United States Patent [19]

LeBlanc et al.

[11] Patent Number: 5,072,912

[45] Date of Patent: Dec. 17, 1991

[54] VAPOR VENT VALVE

[76] Inventors: Leo J. LeBlanc, 4837 Shellmarr La., Bloomfield Hills, Mich. 48013; Bruce R. Johnson, 2374 W. Giles Rd., Muskegon, Mich. 49445

[21] Appl. No.: 727,076

[22] Filed: Jul. 9, 1991

[51] Int. Cl.[5] ..... F16K 31/122

[52] U.S. Cl. ..... 251/63.5; 137/587; 141/59; 141/290; 251/144

[58] Field of Search ..... 137/219, 529, 587; 144/59, 290; 220/85 VR, 85 VS; 251/63.5, 144

[56] References Cited

U.S. PATENT DOCUMENTS 4,721,283 1/1988 Wilson ..... 251/144 X

*Primary Examiner*—Gerald A. Michalsky

[57] ABSTRACT

A pneumatically actuated vent valve for venting the headspace of a fuel storage tank such as generally cylindrical a gasoline delivery truck includes a housing, sealingly mounted in the top of the tank and having a central passage opening at its lower end into the headspace of the tank and opening at its upper end, at the anterior of the tank into a hood. A pneumatic motor cylinder defining a piston chamber closed at its upper end is integrally formed with the housing coaxial to the central passage and a piston rod projecting downwardly from the piston chamber carries a valve head at its lower end disposed below the lower end of the housing. The valve head is normally biased upwardly into sealed engagement with a valve seal at the lower end of the central passage by three (or more) springs biased guide rods symmetrically disposed about the central passage wall. The valve is opened by supplying air under pressure to the upper end of the piston chamber via a flow passage through a web integrally joining the motor cylinder to the housing.

12 Claims, 2 Drawing Sheets

VAPOR VENT VALVE

BACKGROUND OF THE INVENTION

The present invention is directed to a vapor vent valve especially adapted for use on gasoline tank trucks to accommodate the flow of fuel vapor to or from the headspace of the tank during a fuel loading or unloading operation.

Delivery of gasoline by tank truck from the supply terminal to a service station involves two transfers of a substantial volume—several thousand gallons—of gasoline from one tank to another. In that both tanks are sealed to prevent the escape of fuel vapor, the headspace of the tank being emptied must be vented during the emptying to maintain a constant pressure in the headspace, and the headspace of the tank being filled likewise must be vented to accommodate the escape of vapor expelled from the tank by the incoming fuel.

In the past, the underground fuel storage tanks at gasoline service stations were provided with a vent pipe which simply vented the headspace of the tank directly to the atmosphere. This practice is no longer environmentally acceptable in that substantial amounts of fuel vapor were expelled through the vent as the tank was refilled, and many states and localities now require the utilization of a vapor recovery system of some type to prevent vapor expelled from the tank during the filling operation from being disbursed into the atmosphere.

One such vapor recovery system presently in use employs a so-called coaxial elbow to couple the gasoline delivery hose from the tank truck to a central drop tube which passes downwardly freely through the storage tank fill pipe into the tank interior. The drop tube passes freely through the storage tank fill pipe so that a coaxial flow passage surrounding the drop tube is present to provide a flow path for fuel vapor expelled from the tank by the incoming fuel, and this outer flow passage is connected by the coaxial coupling to a delivery hose coupled to a pipe on the truck tank which opens, via a vent valve, into the headspace of the compartment within the truck tank which is supplying fuel to the service station storage tank. With the vent valve open, the headspaces of the underground storage tank and the storage compartment in the truck tank are connected to each other and sealed from the atmosphere so that vapor expelled from the underground storage tank simply flows back into the headspace of the tank from which the incoming fuel is flowing. The same tank truck mounted vent valve and vapor delivery pipe may be utilized at the terminal when the truck tank is being filled to conduct the vapor expelled from the truck tank during the filling operation to some vapor storage facility at the terminal.

The present invention is especially directed to an improved vent valve intended for use in a vapor recovery system of the type described above.

SUMMARY OF THE INVENTION

A vent valve embodying the present invention utilizes a generally cylindrical or hollow tubular housing which is provided with suitable means for mounting the housing within an opening through the top wall of a tank with the housing axis extending vertically and the lower end of the central passage through the housing opening into the interior of the tank and the upper end opening at the exterior of the tank. A diametrically extending web integrally formed with the housing extends radially across the central passage and a cylindrical enlargement at the midsection of the web coaxially aligned with the central passage forms the cylinder of a pneumatic valve actuating motor. A piston receiving chamber within the cylinder is defined by a blind bore extending vertically upwardly from the lower end of the cylindrical enlargement, the lower end of the chamber being closed, but not sealed, by a cap slidably receiving the piston rod of a piston received in the chamber. The piston rod projects loosely through the cap and the lower end of the piston rod is fixedly secured to a disk-like valve head adapted to sealingly close the lower end of the central passage.

Three vertically disposed guide rods are fixedly secured at their lower ends to the valve head and extend upwardly from the valve head to be slidably received in vertical guide bores formed in the housing at symmetrically spaced locations about the periphery of the central passage. Biasing springs engaged between the housing and enlarged heads at the upper ends of the guide rods bias the valve head upwardly to a valve closed position seated against the lower end of the outer housing and blocking the lower end of the central passage. An air flow passage extends from a port accessible at the exterior of the upper end of the housing through the web to the upper end of the piston chamber to supply air under pressure to drive the piston, and connected valve head, downwardly to open the lower end of the central passage to accommodate the flow of vapor into or out of the storage tank through the opened vent valve.

The upper end of the housing at the exterior of the tank is detachably connected to a hood which, in the case of a gasoline tanker trailer, provides a fluid passage from the central passage of the vent valve to the interior of a so-called overturn rail conventionally mounted upon such tank trailers. The overturn rail is nothing more than a hollow pipe which in the present application is closed at its forward end and connected at its rearward end to a pipe extension which passes downwardly along the back of the tank to a coupling accessible from ground level. This coupling is employed to couple the pipe to a hose connected to the vapor passage of a coaxial elbow or to some vapor storage system.

Other objects and features of the invention will become apparent by reference to the following specification and to the drawings.

IN THE DRAWINGS

Figure 1:
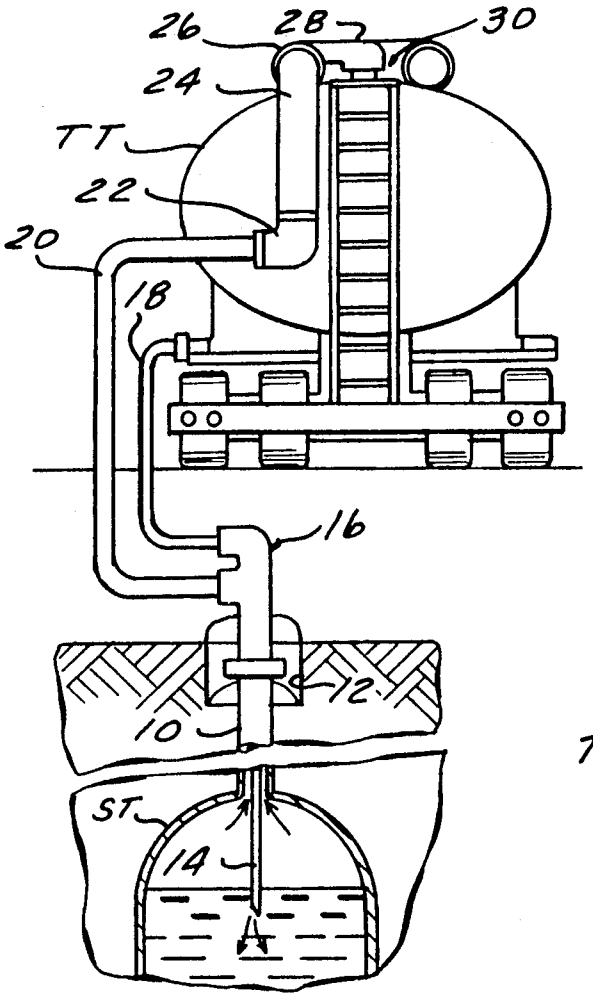
FIG. 1 is a schematic diagram, partially in cross section, of a tanker truck in the process of filling an underground storage tank and utilizing a vent valve embodying the present invention

An overall view of a primary application or utilization of a vent valve according to the present invention is shown in FIG. 1 in which gasoline is being dispensed from the storage tank TT of a tanker truck into an underground storage tank ST at a gasoline service station.

The underground storage tank ST has a fill pipe 10 extending upwardly from the top of the tank to an upper end located within a shallow manhole 12 in the service station apron. A coaxial drop tube 14 is mounted within fill pipe 10 and extends downwardly well into the interior of the tank ST. Drop tube 14 extends upwardly to an upper end located adjacent the upper end of fill pipe 10, the drop tube 14 providing a flow passage through which liquid gasoline flows into tank ST while fuel vapor displaced from the interior of tank ST by the incoming fuel ca flow upwardly through fill pipe 10 in the passage between the exterior of drop tube 14 and the interior of fill pipe 10. A so-called coaxial coupling elbow designated generally 16 is detachably coupled to the upper end of fill pipe 10 for the filling operation. Coaxial elbows such as the elbow 16 are well known and commercially available from several manufacturers. Elbow 16 has one internal passage sealingly connected to drop tube 14 which extends through the elbow to be connected to the fuel delivery hose 18 connected to the tanker truck. A second passage within coupling 16 connects the fuel vapor flow passage between the interior of fill pipe 10 and the exterior of drop tube 14 to a vapor conducting hose 20 extending from the coupling 16 to a coupling 22 on the tanker truck. Coupling 22 is located at the lower end of a vertical pipe 24 connected at its upper end to the overturn rail or a pipe 26 which extends the entire length of the tanker trailer. A hood 28 provides fluid communication between the pipe 26 and a vent valve designated generally 30 embodying the present invention which, when opened, connects the headspace of the interior of the trailer tank TT to the headspace of the underground storage tank ST via hood 28, pipes 26, 24, coupling 22, hose 20, coupling 16 and the interior of fill pipe 10. With valve 30 opened, fuel vapor expelled from the headspace of the underground storage tank ST flows into the headspace of the tank TT from which fuel is being dispensed so that pressure in both headspaces is equalized throughout the filling operation.

Figure 4:
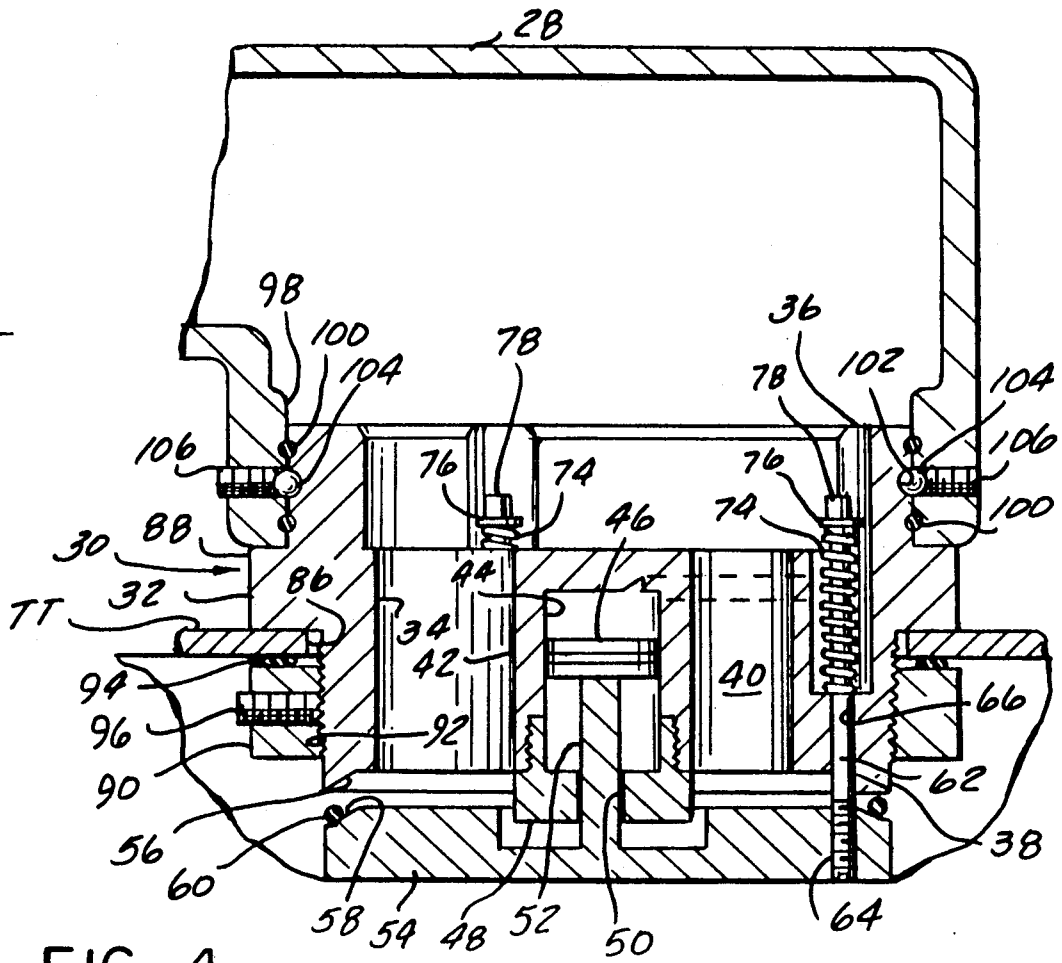
FIG. 4 is a detail cross sectional view, similar to FIG. 3, taken on line 4—4 of FIG. 2, showing the valve in its open position.
Figure 3:
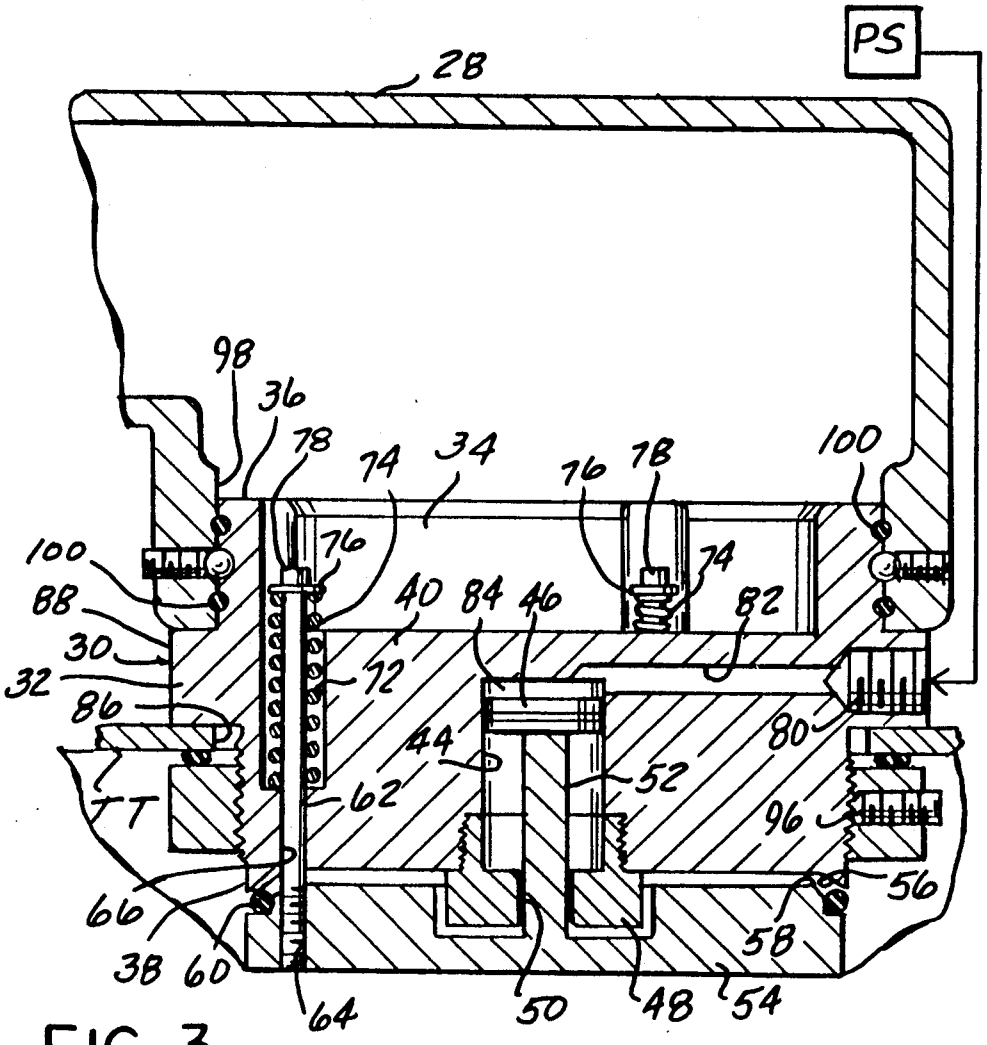
FIG. 3 is a detail cross sectional view of the vent valve of FIG. 2 taken on line 2—2 and showing the valve in its closed position mounted upon a storage tank and connected to a hood, both partially shown.
Figure 2:
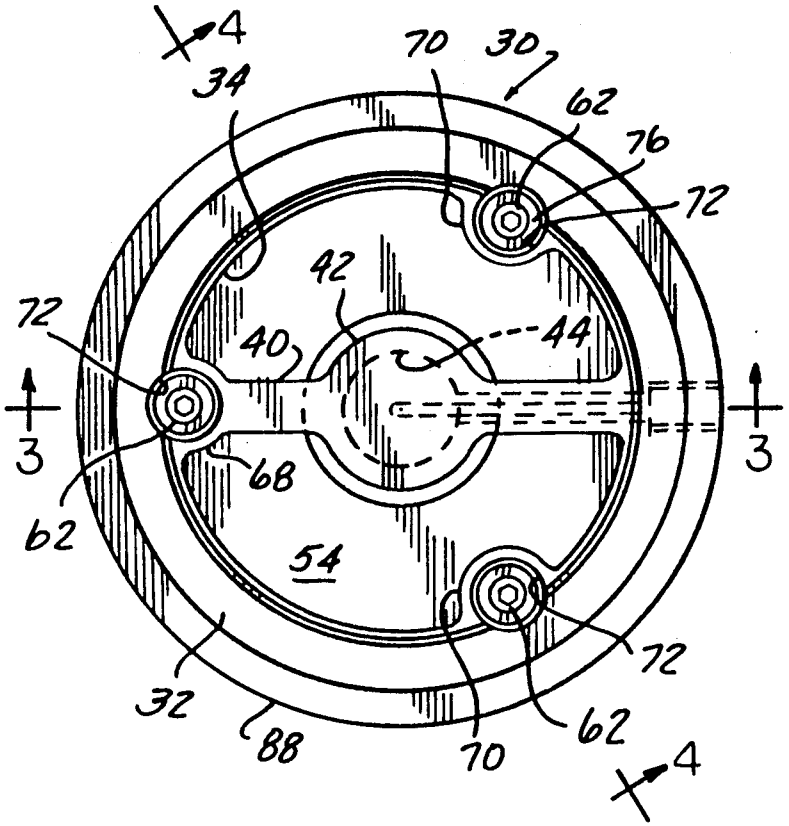
FIG. 2 is a top plan view of a vent valve embodying the present invention.

Details of valve 30 are best seen in FIGS. 2–4.

The valve 30 includes a generally cylindrical housing 32 having a vertically disposed central axis and a central passage 34 extending through the housing from its upper end 36 to its lower end 38. As best seen in FIG. 2, the central passage 34 as viewed from above is bisected by a diametrically extending web 40 having a centrally located cylindrical enlargement 42 disposed coaxially of central passage 34. Web 40 and enlargement 42 are integrally formed with housing 32.

A blind bore 44 extending upwardly from the lower end of enlargement 42 defines a piston chamber within the cylindrical enlargement 42 which slidably receives a piston 46 (FIGS. 3 and 4). The lower end of blind bore 44 is substantially closed by an end cap 48 which, as shown in the drawings, may be threaded into bore 44 or alternatively may be bolted to the bottom end of the cylindrical enlargement. A bore 50 through cap 48 slidably receives a piston rod 52 whose lower end is integral with or may be fixedly secured to a disk-shaped valve head 54 which underlies the lower end of housing 32. As best seen in FIG. 4, the lower end of housing 32 is formed with a downwardly and outwardly inclined frusto conical valve seat surface 56, while the upper side of valve head 54 is formed with a complimentarily inclined frusto conical surface 58 in which is seated a ring seal 60 adapted to seal against valve seat 56 when valve head 54 is in the closed position shown in FIG. 3.

A plurality of guide rods 62 are threaded at their lower end and threadably received in tapped bores 64 in valve head 34 at locations symmetrically disposed, as best seen in FIG. 2, about the axis of central passage 34. Guide rods 62 project upwardly from valve head 54 and are slidably received within guide bores 66 in housing 32. Bores 66 are preferably formed in enlargements such as 68 (FIG. 2) of web 40 or enlargements 70 constituting thickened portions of the wall of housing 32. Enlarged diameter counterbores at the upper end of each guide bore 66 are of a diameter sufficient to receive a compression spring 74 coiled around guide rod 62 and engaged between the bottom of counterbore 72 and a washer 76 engaged beneath an enlarged head 78 at the upper end of each guide rod 62. Springs 74 exert an upwardly directed biasing force urging valve head 54 to the valve closed or seated position shown in FIG. 3.

The closed position is the normal position of the valve to open the valve air under pressure is supplied from a suitable supply source schematically indicated at PS in FIG. 3 to a port 80 in the exterior of housing 32 which communicates with a flow passage 82 extending through web 40 from port 80 to the upper end 84 of the piston chamber defining bore 44.

The valve 30 is mounted within a circular opening 86 in the top of the tank TT. Housing 32 is formed with a radially outwardly projecting mounting flange 88 of a diameter greater than that of opening 86. Below mounting flange 88, a clamping ring 90 threadably received upon a reduced diameter section 92 of the lower end of housing 32 is employed to tightly clamp the wall of tank TT between mounting flange 88 and clamping ring 90, a ring seal 94 sealing this joint. Set screws such as 96 may be employed to rotatively lock the clamping ring in position upon the valve housing.

As best seen in FIGS. 3 and 4, the hood 28 is formed with a passage 98 at one end adapted to be slidably received upon that portion of housing 32 above mounting flange 88. A pair of O-ring seals 100 are employed to seal this joint. Preferably, an annular groove 102 of semi-circular cross section is formed in the upper end of housing 32 between the two seals 100 to receive a ball held within the groove 102 as by a set screw 104. When seated within the groove, the balls 104 hold the hood 28 against axial movement relative to housing 32, but accommodate relative rotation between the housing and hood as may be required during the installation of the valve and hood upon a tanker. The O-ring seals 100 do not require that the housing and hood be locked against rotation, although by tightening the set screws 106, relative rotation of the two elements may be severely restricted.

While one embodiment of the invention has been described in detail, it will be apparent to those skilled in the art the disclosed embodiment may be modified. Therefore, the foregoing description is to be considered exemplary rather than limiting, and the true scope of the invention is that defined in the following claims.

In the claims:

1. A vent valve for venting the interior of a storage tank, said vent valve comprising:

a hollow tubular housing having a central passage extending axially therethrough from one end of said housing to the other, mounting means on the exterior of said housing for fixedly and sealingly mounting said housing in an opening through a top wall of said storage tank with said one end of said housing disposed at the exterior of said tank and the other end of said housing disposed within the interior of said tank, means at said other end of said housing defining an annular valve seat, a valve head member mounted for movement axially of said housing toward and away from said valve seat and operable in a valve closed position to sealingly engage said seat to sealingly close said central passage at said other end of said housing, means integral with said housing defining a piston chamber sealed at one end and extending coaxially of said central passage, a piston slidably and sealingly received within said piston chamber, a piston rod fixedly secured to said piston and projecting from the other end of said chamber to a piston rod end fixedly secured to said valve head member, a plurality of spring means engaged between said housing and said valve member at locations within said central passage externally of said piston chamber and symmetrically disposed about said axis biasing said valve member toward said valve closed position, and flow passage means extending through said housing into said one end of said piston chamber for supplying pressure to said one end of said chamber to drive said valve head member away from said seat to open said other end of said central passage.

2. The invention defined in claim 1 wherein said means defining said piston chamber comprises web means integral with said housing extending radially across said central passage, a cylindrical enlargement on said web means extending coaxially of said central passage and having a blind coaxial bore therein opening at the end of said enlargement adjacent said other end of said housing defining said piston chamber.

3. The invention defined in claim 2 wherein said flow passage means is defined by a flow passage extending radially through said housing from a location at the exterior of said tank through said web means to open into said blind bore adjacent the inner end thereof.

4. The invention defined in claim 3 wherein said mounting means comprises a radially outwardly projecting annular flange on the exterior of said housing of a diameter larger than the diameter of the opening through the wall of said tank and engageable with the exterior side of the wall of said tank, a reduced diameter coupling portion extending from said flange to said one end of said housing for sealingly coupling a vapor receiving hood to said one end of said housing, and means defining a port in said flange in fluid communication with said flow passage.

5. The invention defined in claim 1 wherein each of said spring means comprises a rigid guide rod fixedly secured at one end to said valve head member, means defining a guide bore having a small diameter guide section extending axially into said housing from said other end to a radially outwardly extending spring seat shoulder facing said one end of said housing, said guide rod being slidably received within said guide section and projecting from said guide section beyond said shoulder to a distal end, and compression spring means engaged between said shoulder and a spring retaining mounted on said distal end of said guide rod.

6. The invention defined in claim 5 wherein said spring seat shoulder is defined by a counterbore of a diameter larger than that of said guide section extending into said housing from said one end in coaxial alignment with said guide section, and said spring means is a coil spring freely received in said counterbore and coiled about said guide rod.

7. The invention defined in claim 6 wherein said valve seat is of frusto conical configuration and said valve head comprises a frusto conical surface of a shape complimentary to that of said seat having an annular O-ring receiving groove therein, and an O-ring received within said groove for sealing engagement with said valve seat when said valve head is in said closed position.

8. The invention defined in claim 6 wherein said plurality of spring means comprises at least three spring means.

9. A pneumatically actuated vapor vent valve for a fuel storage tank comprising a vertically displaced hollow generally cylindrical housing having a central passage extending axially therethrough from the upper end of said housing to the lower end of said housing, means for mounting said housing in an opening in the top of said tank with the upper end of said housing at the exterior of said tank and the lower end of said housing within said tank, a pneumatic motor including a motor cylinder having a piston chamber therein fixedly mounted within said central passage coaxially thereof adjacent the lower end of said housing, a piston operatively received within said piston chamber and having a piston rod projecting downwardly from the lower end of said motor cylinder, a disc like valve head fixedly secured to the lower end of said piston rod and movable with said piston rod upwardly and downwardly relative to said housing to and from a valve closed position wherein said head is in sealed engagement with an annular valve seat on the lower end of said housing, a plurality of guide bores extending axially upwardly into said housing from the lower end thereof located at symmetrically spaced positions about the axis of said housing, said guide bores each having a relatively small diameter lower guide section and a relatively large diameter spring receiving upper section, a guide rod slidably received in the guide section of each guide bore, each guide rod being fixedly secured at its lower end to said valve head and projecting upwardly from said head through said guide section into the associated upper section of said guide bore, an enlarged head means at the upper end of each guide rod, and a coil spring slidably received on each guide rod and engaged between the guide rod head means and the lower end of said upper section of said bore to bias said valve head upwardly toward said seat, and means defining a flow passage through said housing for conducting air under pressure to and from that portion of said piston chamber above said piston.

10. The valve defined in claim 9 wherein said motor cylinder is integrally joined to said housing by web means extending radially from said cylinder to the wall of said central passage, said flow passage extending from a port at the exterior of said housing through said web means to open into the upper end of said piston chamber.

11. The invention defined in claim 9 wherein said annular valve seat comprises a downwardly and outwardly inclined frusto conical surface at the lower end of said housing, said valve head having a complimentarily inclined frusto conical surface in opposed face to face relationship to said frusto conical surface at the lower end of said housing, said frusto conical surface of said valve head having a ring seal seated in an annular groove therein.

12. The invention defined in claim 9 wherein said piston chamber is defined by a blind bore extending vertically upwardly from the lower end of said cylinder, and an end cap detachably secured to said cylinder at the lower end of said blind bore for slidably guiding said piston rod.

* * * * *